US008955648B1

(12) United States Patent
Weller

(10) Patent No.: US 8,955,648 B1
(45) Date of Patent: Feb. 17, 2015

(54) MOTOR HOME DUMBWAITER

(76) Inventor: Ronald Kenneth Weller, La Mesa, CA (US)

( * ) Notice: Subject to any disclaimer, the term of this patent is extended or adjusted under 35 U.S.C. 154(b) by 0 days.

(21) Appl. No.: 13/599,081

(22) Filed: Aug. 30, 2012

Related U.S. Application Data

(60) Provisional application No. 61/642,294, filed on May 3, 2012.

(51) Int. Cl.

| | |
|---|---|
| ***B66B 11/06*** | (2006.01) |
| ***B66D 1/34*** | (2006.01) |
| ***A47B 51/00*** | (2006.01) |
| ***B66B 7/04*** | (2006.01) |
| ***B66B 13/00*** | (2006.01) |

(52) U.S. Cl.
USPC ..... 187/262; 187/338; 254/286; 254/338; 312/272.5; 312/306; 312/312

(58) Field of Classification Search
CPC .. B66B 9/0815; B66B 9/0823; B66B 11/007; B66B 11/0075; B66B 11/009; B66B 9/00; B66B 11/06
USPC ..... 254/285, 312, 334, 338, 286; 182/141, 182/150; 187/254, 261, 262, 263, 266, 244, 187/338, 343; 312/306, 319.7, 350, 272.5; 296/156, 164, 168, 24.4, 107.08
IPC ..... A47B 51/00
See application file for complete search history.

(56) References Cited

U.S. PATENT DOCUMENTS

| | | | | | |
|---|---|---|---|---|---|
| 90,422 | A | * | 5/1869 | Cannon, Jr. | 187/263 |
| 450,905 | A | * | 4/1891 | Anderson | 187/338 |
| 497,922 | A | * | 5/1893 | Koeberlein | 187/262 |
| 804,957 | A | * | 11/1905 | Keller | 187/302 |
| 922,620 | A | * | 5/1909 | O'Donnell | 187/326 |
| 1,003,253 | A | * | 9/1911 | Hallett | 312/247 |
| 1,035,230 | A | * | 8/1912 | Pearon | 187/254 |
| 1,210,817 | A | * | 1/1917 | Lindholm | 187/338 |
| 1,404,832 | A | * | 1/1922 | Butler et al. | 187/414 |
| 1,867,568 | A | * | 7/1932 | Hirshfeld | 187/254 |
| 3,356,183 | A | * | 12/1967 | Shell | 312/272.5 |
| 3,608,674 | A | * | 9/1971 | Phillips | 187/270 |
| 3,801,070 | A | * | 4/1974 | Piasecki | 254/285 |
| 4,287,967 | A | * | 9/1981 | Perkins | 187/268 |
| 4,593,474 | A | * | 6/1986 | Mayhew | 33/264 |
| 4,942,328 | A | * | 7/1990 | Price | 312/272.5 |
| 5,273,352 | A | * | 12/1993 | Saper | 312/7.2 |
| 5,673,771 | A | * | 10/1997 | Rivera | 187/406 |

(Continued)

FOREIGN PATENT DOCUMENTS

| | | | | | |
|---|---|---|---|---|---|
| DE | 4105901 | A1 | * | 8/1992 | B66B 9/00 |
| FR | 2275400 | A1 | * | 1/1976 | B66B 11/06 |

(Continued)

*Primary Examiner* — William A Rivera
*Assistant Examiner* — Stefan Kruer
(74) *Attorney, Agent, or Firm* — Michael D. Eisenberg

(57) ABSTRACT

A dumbwaiter is provided. The dumbwaiter includes an elevator mechanically coupled to a left glide and a right glide. The left glide is immediately adjacent to and located between a pair of left guides, and the right glide is immediately adjacent to and located between a pair of right guides. A strap is used for raising and lowering the elevator. As the glides are bound between respective pairs of guides, the elevator is protected from vibration. Thus, the dumbwaiter of the present invention may be suitable for being used in a mobile setting, such as a motor home in transit, for example.

3 Claims, 3 Drawing Sheets

(56) References Cited

U.S. PATENT DOCUMENTS

| | | | | |
|---|---|---|---|---|
| 5,797,666 | A * | 8/1998 | Park | 312/319.5 |
| 6,000,770 | A * | 12/1999 | Frich | 312/319.7 |
| 6,167,670 | B1 * | 1/2001 | Reite et al. | 52/637 |
| 6,238,159 | B1 * | 5/2001 | Pappas | 414/10 |
| 6,471,311 | B1 * | 10/2002 | Snyder | 312/247 |
| 6,676,233 | B1 * | 1/2004 | Evans et al. | 312/247 |
| 7,806,490 | B1 * | 10/2010 | Buehl | 312/312 |
| 2003/0102189 | A1 * | 6/2003 | O'Donnell et al. | 187/259 |
| 2005/0098387 | A1 * | 5/2005 | Penn et al. | 187/262 |
| 2008/0079337 | A1 * | 4/2008 | Vardaro et al. | 312/138.1 |

FOREIGN PATENT DOCUMENTS

| | | | | |
|---|---|---|---|---|
| JP | 01040004 | A * | 2/1989 | A47B 51/00 |
| JP | 2002177062 | A * | 6/2002 | A47B 51/00 |
| WO | WO 2008041850 | A1 * | 4/2008 | B66D 1/16 |

* cited by examiner

MOTOR HOME DUMBWAITER

CROSS REFERENCE TO RELATED APPLICATIONS

This application claims priority to U.S. Provisional Application 61/642,294 filed on May 3, 2012.

FIELD OF THE INVENTION

This invention relates device that can transport goods from a first elevation to a second elevation.

BACKGROUND OF THE INVENTION

Dumbwaiters have been used in homes in some rudimentary fashion since the 18th century. However, those dumbwaiters were particularly suited for static structures. The prior art includes: U.S. Patent Application 2008/0116016 filed by Darnley and U.S. Pat. No. 6,527,088 issued to Fowler.

Darnley teaches a dumbwaiter lift using a stainless steel cable instead of a belt, but with a largely similar pulley setup connection to a motor. Darnley uses rails instead of wooden and plastic guides to move the dumbwaiter. Fowler teaches a belt and pulley system with switches for operating a dumbwaiter that moves on a single rail. The fundamental difference with both Darnley and Fowler and the present invention is that Darnely and Fowler are intended for static systems that do not move. Motorhomes move. As a result, one requires more guides to keep the device from falling apart during a transit, Darnely and Fowler have no teaching or structure on this matter.

BRIEF SUMMARY OF THE INVENTION

A motor home dumbwaiter comprises an elevator mechanically coupled to a left glide and a right glide. The left glide and the elevator are mechanically coupled to a left strap roller. The right glide and the elevator are mechanically coupled to a right strap roller. The left glide is immediately adjacent to left guides and the right glide is immediately adjacent to right guides. A strap is mechanically coupled to a cabinet proximate the left guides and is immediately adjacent to the right strap roller and the left strap roller; the strap is mechanically coupled to a motor which can wind and unwind the strap. In this manner, the motor can raise the elevator by winding the strap and lower the elevator by unwinding the strap. When the elevator is raised the elevator is protected from vibration of a motor home in transit by the positioning of the left glide, the right glide, the left guides and the right guides.

BRIEF DESCRIPTION OF THE SEVERAL VIEWS OF THE DRAWINGS

Figure 1:
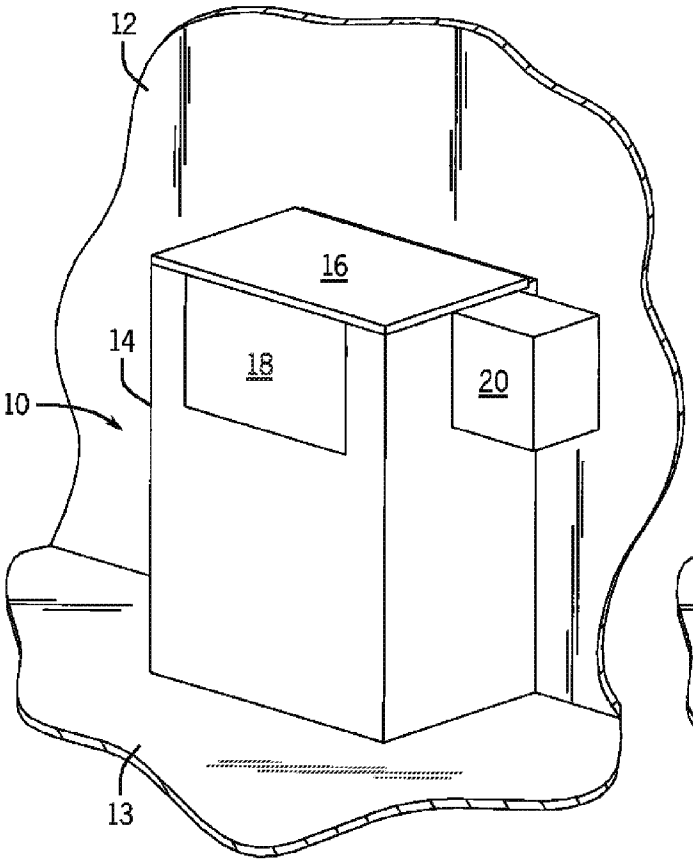

Having thus described the invention in general terms, reference will now be made to the accompanying drawings, which are not necessarily drawn to scale, and wherein:

FIG. 1 is a front perspective view of the invention.

Figure 2:
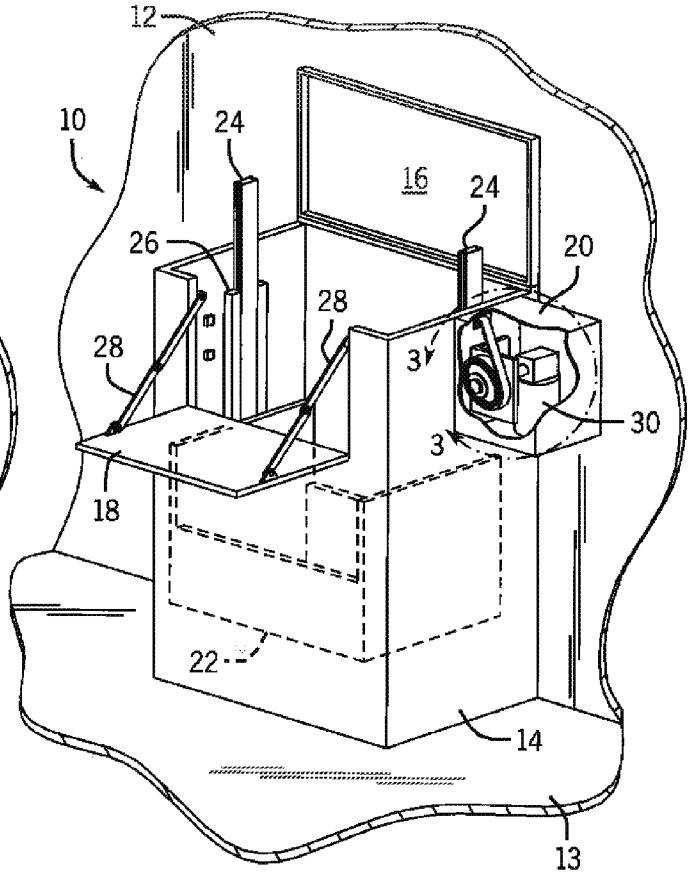

FIG. 2 is a front perspective view showing the invention in an operating mode.

Figures 3, 4:
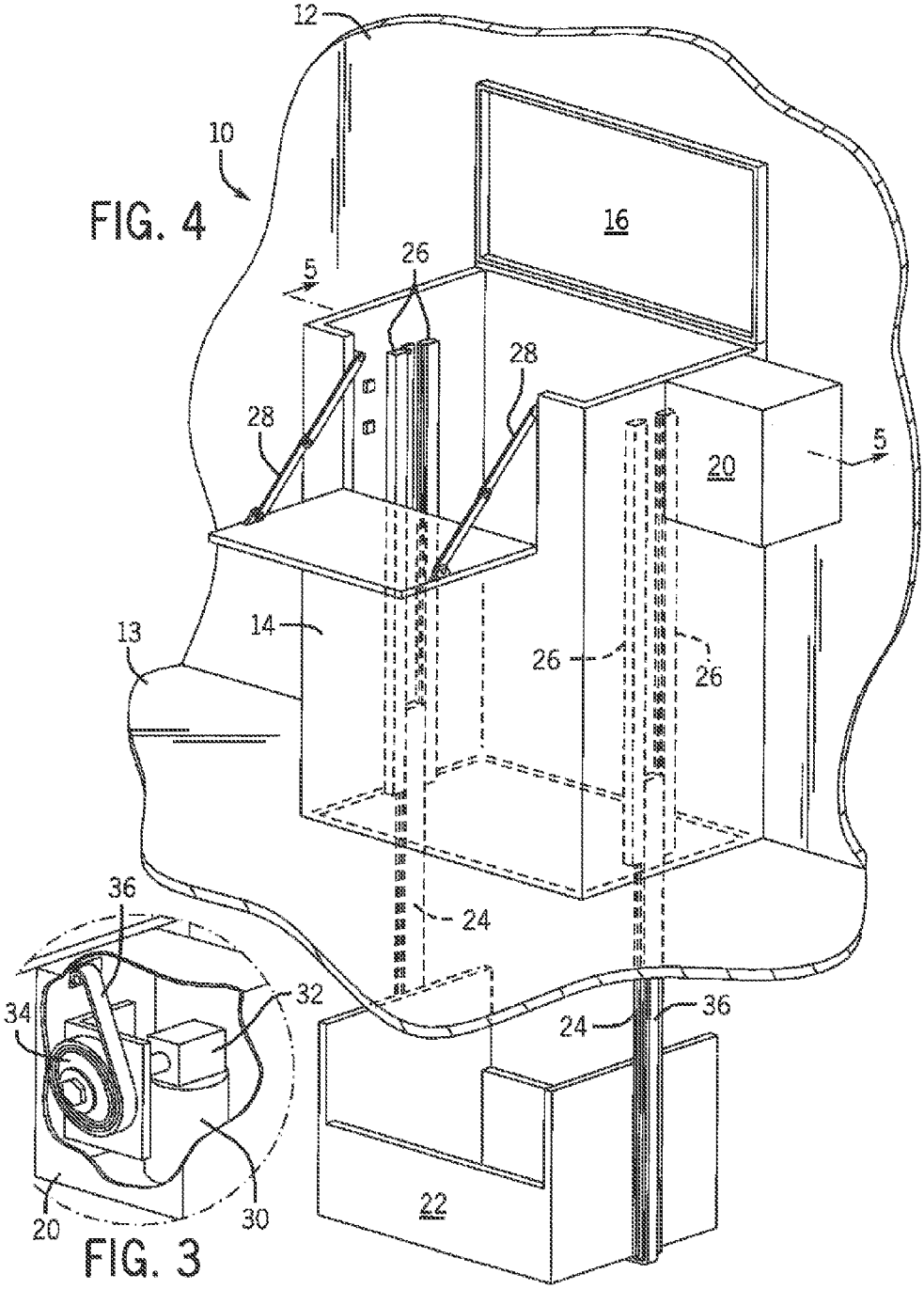

FIG. 3 is a detail perspective view.

FIG. 4 is a front perspective view showing the invention in a deployed mode.

Figures 5, 6:
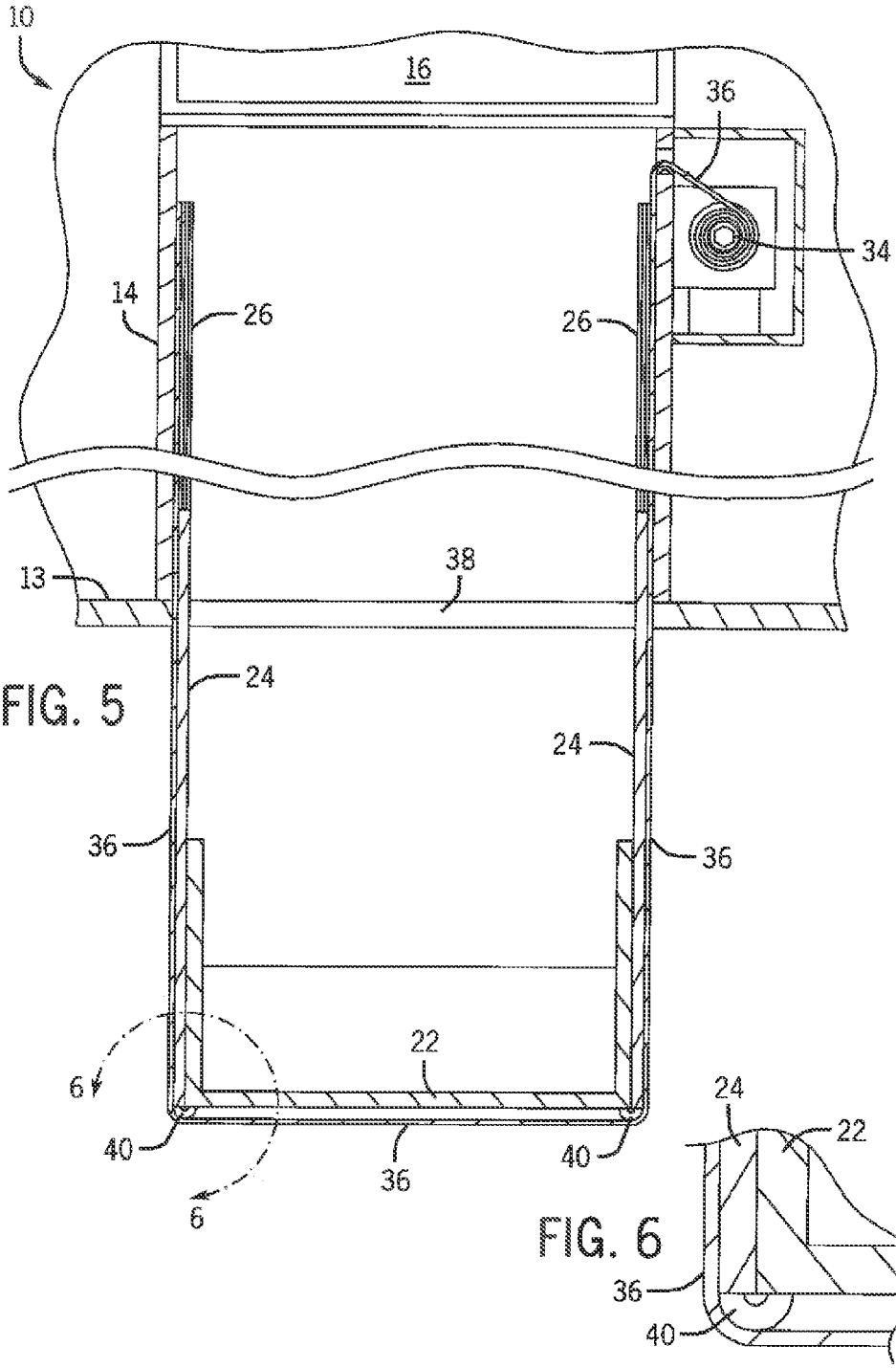

FIG. 5 is a detail cross-sectional view taken on line 5-5 of FIG. 4.

FIG. 6 is a detail cross-sectional view indicated by line 6-6 of FIG. 5

DETAILED DESCRIPTION OF THE INVENTION

Embodiments of the present invention overcome many of the obstacles associated with maneuvering goods in and out of motor homes, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows a perspective view of a motor home dumbwaiter. Dumbwaiter 10 is designed to rest upon floor 13 and against wall 12 of a motorhome. Dumbwaiter 10 comprises cabinet 14 which is mechanically coupled to lift compartment 20. Cabinet 14 further comprises lift top 16 and front door 18 which are shown in more detail in FIG. 2.

FIG. 2 shows dumbwaiter 10 in a little more detail. Front door 18 is mechanically coupled to cabinet 14 by two articulated struts 28 which can allow greater access to elevator 22. Cabinet 14 is mechanically coupled to guides 26, which are immediately adjacent to glides 24. Right guides 26 allow right glide 24 to move in only a vertical direction. Likewise, left guides 26 allow left glide 24 to move in only a vertical direction. This reduced mobility of glides 26 and thus elevator 22 prevent vibration which can otherwise damage elevator 22. In this manner, the prior art teaches away from using guides in static structures because no need for guides exist. Glides 24 are mechanically coupled to elevator 22 and can be used to raise and lower elevator 22 as shown in FIG. 4 and FIG. 5. Lift compartment 20 further comprises motor 30, which is shown in more detail in FIG. 3.

FIG. 3 shows motor 30 in more detail. Motor 30 is mechanically coupled to gearbox 32, which is further mechanically coupled to pulley 34. In this manner motor 30 can be activated in a known manner to turn gearbox 32 and thus pulley 34. Pulley 34 is immediately adjacent to strap 36. Strap 36 is used to raise and lower elevator 22 as shown in FIG. 4.

FIG. 4 shows how strap 36 raises and lowers elevator 22. Elevator 22 is mechanically coupled to right glide 24 and left glide 24. Strap 36 runs from pulley 34 (as noted in FIG. 3) down alongside right glide 24 under elevator 22 immediately adjacent to left glide 24 against a left wall on cabinet 14 where strap 36 is mechanically coupled between two guides on the left side of cabinet 14 to cabinet 14. This is shown in more detail on FIG. 5 and FIG. 6.

FIG. 5 and FIG. 6 show the path of belt 36 in more detail. The purpose of a dumbwaiter is to move goods from a first elevation to a second elevation. The present invention demonstrates a first elevation above floor 13 and a second elevation is below floor 13. Here elevator 22, can be raised and lowered through hole 38 in floor 13. Elevator 22 and right glide 24 are mechanically coupled right strap roller 40. Likewise, elevator 22 and left glide 24 are mechanically coupled to left strap roller 40. The strap rollers 40 enable strap 36 to easily move in and out of pulley 34. In this manner as strap 36 is wrapped around pulley 34, elevator 22 is lifted. Likewise as strap 36 is unwound from pulley 34, elevator 22 is lowered.

From this arrangement the prior art problems of vibration caused by a moving vehicle are resolved in this manner. Horizontal movement is limited because the cabinet uses the glides and guides to hold elevator 22 in place. To the extent movement occurs it is dampened by strap 36. Vertical movement is likewise tempered by strap 36 as the motor home might encounter potholes or other obstructions on its path. Lateral movement is limited by the geometry of cabinet 14 which prohibits elevator 22 from moving laterally when raised as glides 24 between guides 26 restrain the lateral and horizontal movement of elevator 22.

What is claimed is:

1. A dumbwaiter, comprising:

an elevator mechanically coupled to a left glide and a right glide;

a left strap roller mechanically coupled to the left glide and the elevator;

a right strap roller mechanically coupled to the right glide and the elevator;

a cabinet having a left wall and a right wall facing each other, and a pair of left guides joined to the left wall and a pair of right guides joined to the right wall opposite to the pair of right guides, the left glide being immediately adjacent to and located between left guides, and the right glide being immediately adjacent to and located between right guides;

a strap having a first end mechanically coupled to the cabinet in a vicinity of the left guides, and a second end being mechanically coupled to a pulley located proximate to the right guides, the strap running from the first end via the pulley, alongside the right glide, under the elevator, between the left guides, to the second end, and being immediately adjacent to the right strap roller and the left strap roller; and a motor coupled to the pulley and configured for turning the pulley so as to wind and unwind the strap around the pulley, in order to raise the elevator by winding the strap and lower the elevator by unwinding the strap;

wherein the cabinet further comprises a lift top, the lift top being a cover which covers at least part of the cabinet's top and is openable to provide access to the elevator; and wherein the glides are configured for protruding upward from the cabinet when a height of the elevator is larger than predetermined height and for pushing the lift top upward, thus facilitating an opening of the lift top.

2. The dumbwaiter of claim 1, wherein the cabinet is mechanically coupled to a lift compartment which houses the motor and the pulley.

3. The dumbwaiter of claim 1, wherein the cabinet further comprises a front door.

* * * * *